US007306442B2

(12) United States Patent
Fox

(10) Patent No.: US 7,306,442 B2
(45) Date of Patent: Dec. 11, 2007

(54) PNEUMATIC MUD STAMP

(76) Inventor: Shirl G. Fox, 2074 Abby Pl., Manteca, CA (US) 95336

( * ) Notice: Subject to any disclaimer, the term of this patent is extended or adjusted under 35 U.S.C. 154(b) by 0 days.

(21) Appl. No.: 11/264,579

(22) Filed: Oct. 31, 2005

(65) Prior Publication Data

US 2007/0098830 A1 May 3, 2007

(51) Int. Cl.
*B28B 3/00* (2006.01)

(52) U.S. Cl. ..... 425/87; 425/458; 222/389; 222/393; 222/564; 401/266; 401/263; 401/176

(58) Field of Classification Search ..... 425/458, 425/87, 12; 156/574, 575; 222/389, 392, 222/564; 401/263, 265, 266, 187, 176
See application file for complete search history.

(56) References Cited

U.S. PATENT DOCUMENTS 4,201,801 A 5/1980 Hori
4,406,730 A * 9/1983 Altmix ..... 156/574
4,930,179 A 6/1990 Wright et al.
5,000,671 A 3/1991 Nolte
5,401,231 A 3/1995 Hebert
5,524,316 A 6/1996 Johnson
5,695,788 A * 12/1997 Woods ..... 425/87
5,882,133 A * 3/1999 Chao et al. ..... 401/266
5,882,691 A * 3/1999 Conboy ..... 425/87
D419,409 S 1/2000 Stover, Jr. et al.
6,196,742 B1 * 3/2001 Tarver, III ..... 401/5
6,299,686 B1 * 10/2001 Mills ..... 118/207
6,581,805 B2 * 6/2003 Conboy et al. ..... 222/340

* cited by examiner

*Primary Examiner*—Yogendra Gupta
*Assistant Examiner*—Maria Veronica Ewald
(74) *Attorney, Agent, or Firm*—Advantia Law Group; Michael W. Starkweath; Jason P. Webb

(57) ABSTRACT

There is a pneumatic mud stamp including an applicator, a tube-like member, a stopper, a retraction mechanism, ad a pneumatic control. The applicator is configured to apply mud in a pattern and includes a boot and a faceplate with a slot. The tube-like member is coupled to the applicator and includes a first chamber configured to hold mud, a second chamber configured to hold pressurized air, and a decoupling mechanism configured to open the tube-like member for insertion of mud therein. The stopper is slidably disposed within the tube-like member between the first and second chambers. The stopper provides a fluid tight seal therebetween. The retraction mechanism is configured to facilitate moving the stopper away from the applicator. The pneumatic control is configured to selectably dispose pressurized air into the second chamber.

10 Claims, 3 Drawing Sheets

PNEUMATIC MUD STAMP

BACKGROUND OF THE INVENTION

1. Field of the Invention

The present invention relates to applicators, specifically to pneumatic mud stamps.

2. Description of the Related Art

U.S. Pat. No. 5,000,671 to Nolte discloses a hand held, self cleaning, machine which uses embossed design rollers to sculpture designs on walls or ceilings. It puts embossed designs on walls or ceilings, in prepared areas of mortar, joint compound, clay, or cement. The machine uses a water jet spray to continuously clean the design roll and vacuum to continuously remove the contaminated water.

U.S. Pat. No. 5,524,316 to Johnson discloses a hand tool for spreading plaster on a substrate such as a ceiling and the like in decorative designs in a repeating pattern having a stiff but resilient blade with a serrated distal, longitudinal edge. A handle is attached to the resilient blade at an opposite or proximal edge of the resilient blade from the serrated distal edge of the resilient blade. In one embodiment, the resilient blade includes two spaced-apart tool alignment marks for aligning the tool with a previously-made design of the pattern to align the next repeated design therewith. In another embodiment, the hand tool includes a pivot device associated with the resilient blade proximate one end of the resilient blade to define a location on the substrate about which the tool is to be moved to generate the design.

U.S. Pat. No. 4,201,801 to Horl discloses a decorative relief pattern is formed on an article or substrate by first forming a layer of highly viscous material on the surface of the article or substrate, followed by applying a plurality of times to such a layer a roller having a surface design arrangement formed of a single design unit, or of several single design units, each design unit being made up of curved, linear convex bodies. The linear bodies may in fact be continuous lines or disconnected lines. Alternatively, the pattern is formed by applying the roller several times to the surface of the article or substrate while at the same time feeding the highly viscous material thereto. The method can provide an article or substrate with a decorative relief pattern having no directional traces in the direction of the rotary movement of the roller.

What is needed is a pneumatic mud stamp that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available pneumatic mud stamps. Accordingly, the present invention has been developed to provide an air stamp.

In one embodiment, the pneumatic mud stamp includes an applicator, a tube-like member, a stopper, a retraction mechanism, and a pneumatic control. The applicator may be configured to apply mud in a pattern and may include a boot and/or a faceplate with a slot. The tube-like member may be coupled to the applicator and/or may include a first chamber configured to hold mud, a second chamber configured to hold pressurized air and a decoupling mechanism configured to open the tube-like member for insertion of mud therein.

The stopper may be slidably disposed within the tube-like member between the first and second chambers. The stopper may provide a fluid tight seal therebetween. The retraction mechanism may be configured to facilitate moving the stopper away from the applicator. The pneumatic control may be configured to selectably dispose pressurized air into the second chamber.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
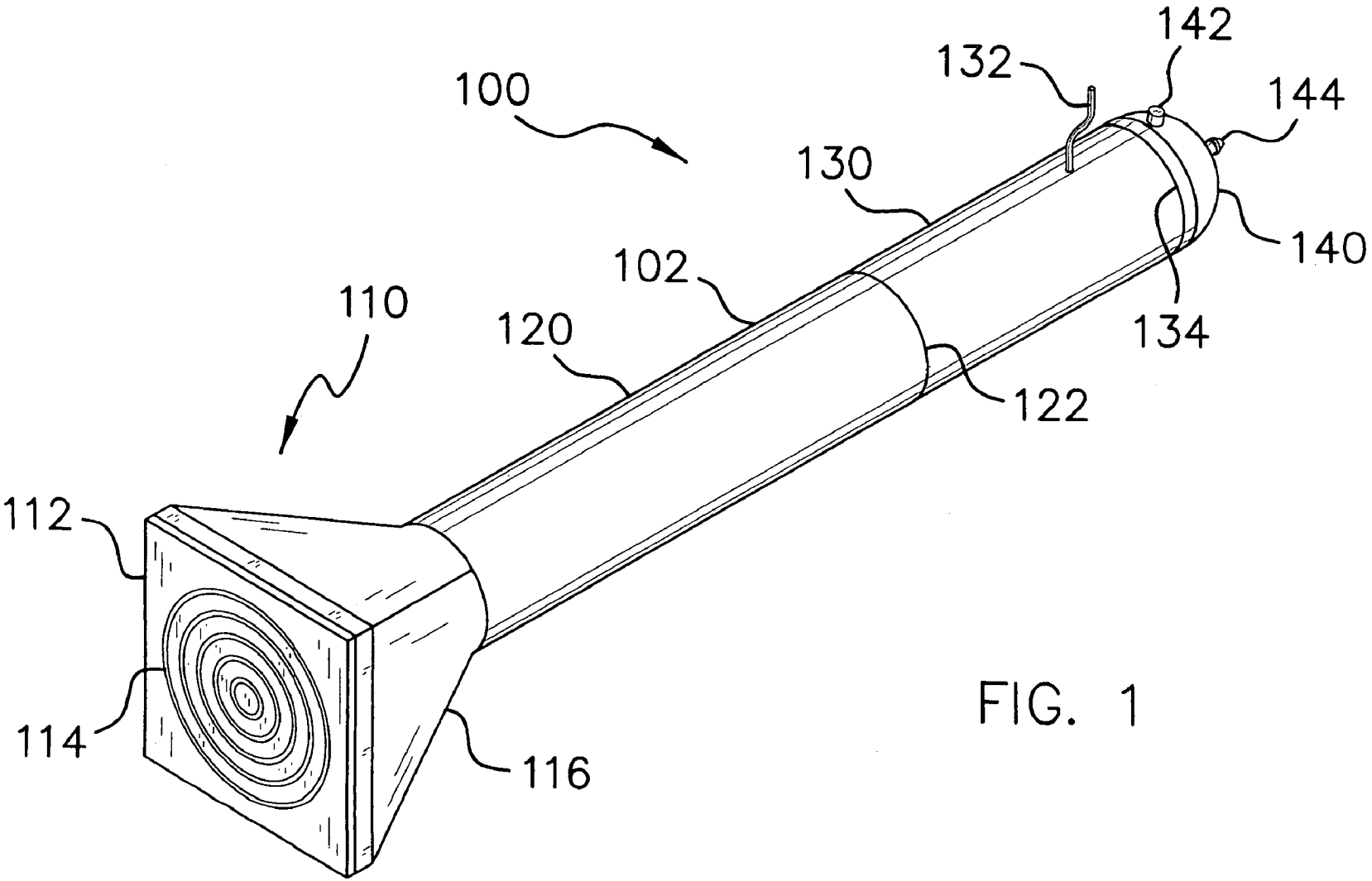
FIG. 1 illustrates a perspective view of a pneumatic mud stamp according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment,"and the like, at the beginning of every sentence herein where logically possible and appropriate.

Figure 2:
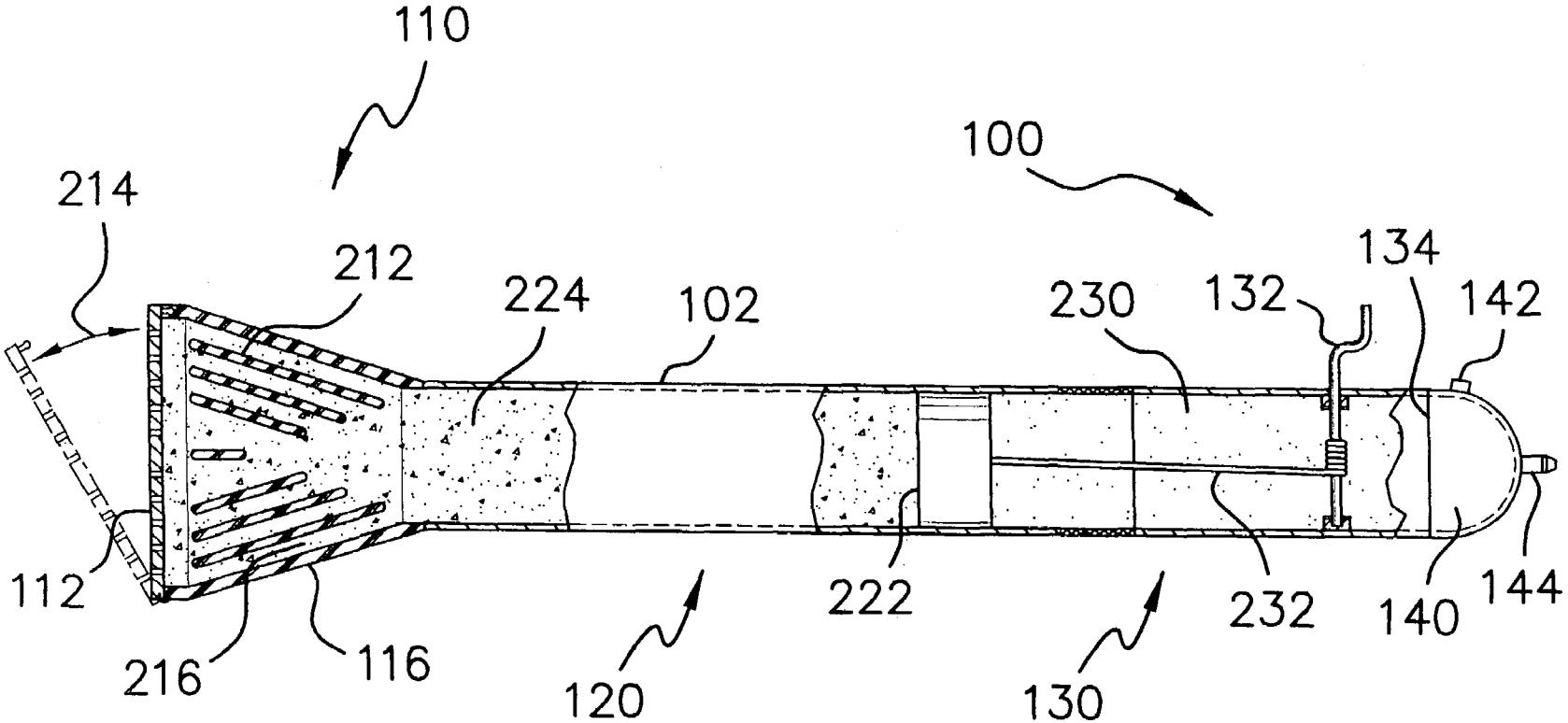
FIG. 2 illustrates a cross-sectional side view of a pneumatic mud stamp according to one embodiment of the invention.

FIGS. 1 and 2 illustrate a pneumatic mud stamp according to one embodiment of the invention. In particular there is shown a pneumatic mud stamp 100 including an applicator 110, a tube-like member 102 defining a first chamber 120 and a second chamber 130, and a device housing or pneumatic control 140.

The applicator 110 includes a faceplate 112 and a boot 116. The faceplate 112 includes one or more slots 114 that may be in any design. Non-limiting examples of designs include western and/or southwestern themes such as designs resembling and/or associated with Native American wall/cave drawings. There may be a raised portion associated with the design and/or one or more slots such as similar to that of a leather stamp. A spiral design slot 144 is shown. The faceplate 112 may be removably coupled to the boot 116 as shown by arrows 214, such as but not limited to by one or more clips, pins, bolts, screws, swivels, etc. The boot 116 includes one or more, preferably a plurality, of channel members or louvers 212 forming channels 216 therebetween. Preferably the boot 116 is constructed of neoprene and the faceplate 112 is stainless steel.

Looking to the first chamber 120, the first chamber is defined by a tube-like member 102, preferably a rigid cylindrical member coupled to the applicator 110. An amount of material 224 is disposed therein for dispersal through the applicator 110. The first chamber 120 is in fluid communication with the applicator 110. Also disposed within the first chamber 120 is a stopper 222 that may be a rubber stopper. The stopper 222 is preferably configured to prevent fluid communication between the first chamber 120 and the second chamber 130. The stopper 222 also defines a boundary of each of the first and second chambers 120 and 130, which boundaries may move as the stopper 222 moves.

The second chamber 130 includes the stopper 222 and a retracting mechanism 132 such as, but not limited to a crank and/or spring 132 and cable 232, wherein the cable spools around the crank 132 and is coupled to the stopper 222. Other examples of retracting mechanisms include but are not limited to a spring and a pull-chain. There is also shown a decoupling mechanism 122 for separating the tube-like member into at least two portions, generally associated with the first and second chambers 120 and 130. Such decoupling mechanism 122 may be, but is not limited to, a threaded male and female portion.

There may be a handle that may be a D-shaped handle as is commonly known in the art. An embodiment may be configured to work with standard construction devices, such as but not limited to standard air compressors.

Turning to the device housing 140, there is a swivel 134, an actuator 142, a casing 140, and one or more air ports 144. The swivel 134 is configured to enable the device housing to rotate about an axis substantially parallel to the longitudinal axis of the pneumatic mud stamp 100. The actuator 142 is configured to enable a user to control entry of air into the second chamber 130. The actuator 142 may include a button, a dial, a switch, a toggle, etc. The air port 144 is configured to permit coupling of an air supply, preferably a pressurized air supply, to the pneumatic mud stamp 100. The casing 140 comprises pneumatic devices and/or materials commonly known in the art that may couple the air port 144, the actuator 142 and the second chamber 130 such that actuation of the actuator 142 may drive air from the air port 144 into the second chamber 130.

In operation, a user may decouple the tube-like member at 122, supply a material such as wall mud into the first chamber 120 and then recouple the tube-like member at 122. Then a user may also select a faceplate 112 including a desired slot 114 design and attach such faceplate 112 to the boot 116. The user may couple an air supply to the air port 144 and may actuate the actuator 142, thereby increasing a pressure in the second chamber 130. Increased pressure in the second chamber 130 may cause the stopper 222 to travel such that material may be pushed through the channels 216 to the faceplate 112 and out the slots 114. A user may actuate the actuator 142 while the faceplate 112 is disposed at a surface, such as a wall or a ceiling, and thereby apply material to such surface in a design associated with the design of the slots 114.

There may also be a depth gauge coupled to and/or adjacent thereto at least one of the boot, applicator, and faceplate. The depth gauge may be used by a user to determine and/or control a depth of material applied to the surface.

Figure 3:
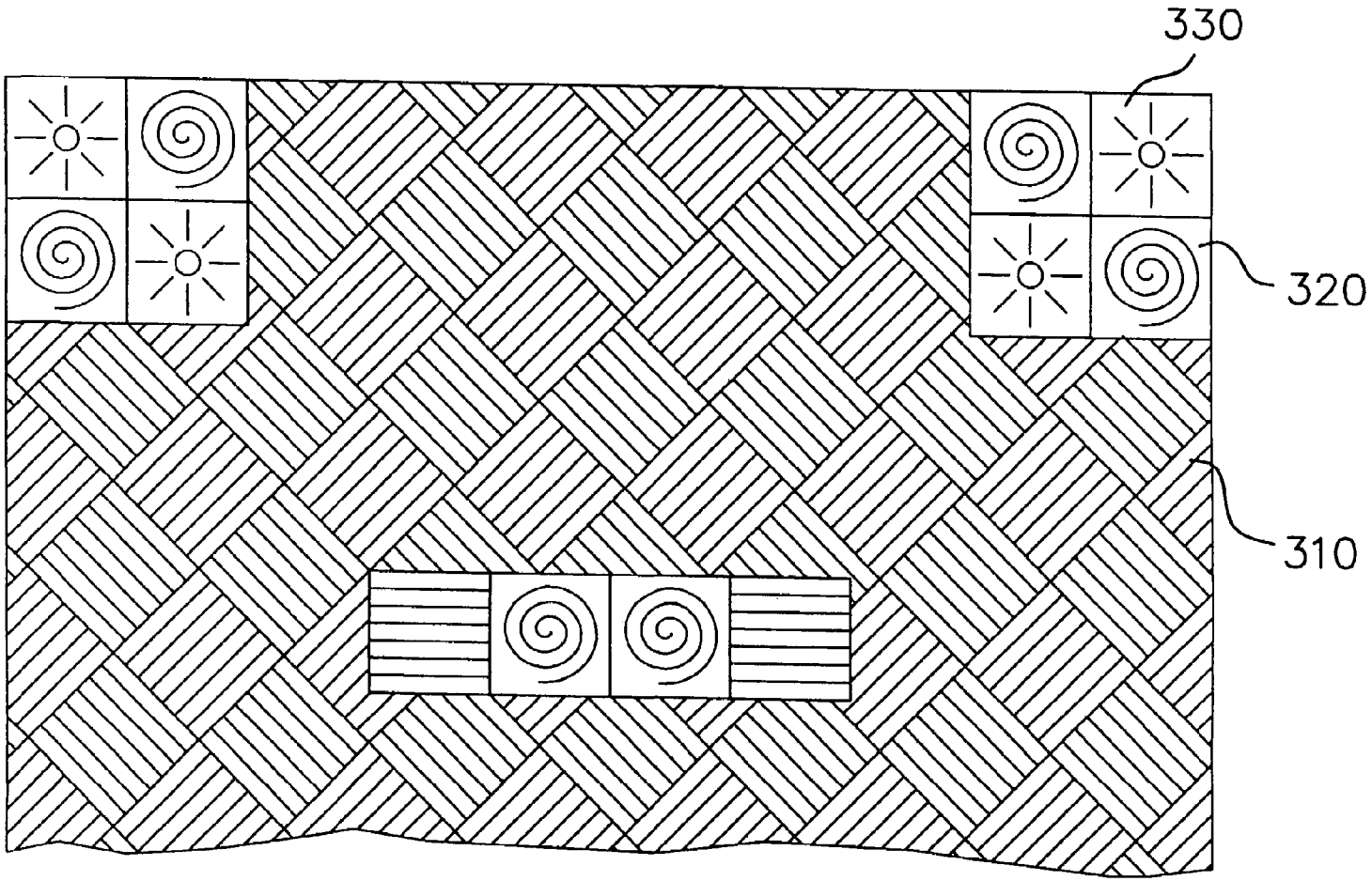
FIG. 3 illustrates a wall design created by a pneumatic mud stamp according to one embodiment of the invention.

FIG. 3 illustrates a wall design created by a pneumatic mud stamp according to one embodiment of the invention. It is shown that an infinite variety of wall designs may be produced by the present invention. There are shown first, second, and third designs 310, 320, and 330 respectively that disposed in relation to one another. Such may be produced by the present invention by altering faceplates and orientation of the applicator 110.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, there may be an embodiment configured primarily for exterior use, an embodiment configured primarily for interior use, and/or an embodiment configured for both interior and exterior use.

Finally, it is envisioned that the components of the device may be constructed of a variety of materials including but not limited to metals, ceramics, resins, plastics, polymers, fibers, and composites.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A pneumatic mud stamp, comprising:

an applicator configured to apply mud in a pattern, including;

a boot;

a faceplate with slots, coupled to the boot; and a plurality of louvers internally disposed in the boot forming a channel therebetween;

a tube-like member coupled to the applicator and including:

a first chamber configured to hold mud; and a second chamber configured to hold pressurized air;

a stopper slidably disposed within the tube-like member between the first and second chambers, the stopper providing a fluid tight seal therebetween; and a pneumatic control configured to selectably dispose pressurized air into the second chamber.

2. The pneumatic mud stamp of claim 1, further comprising a retracting mechanism coupled to the stopper and configured to facilitate moving the stopper away from the applicator.

3. The pneumatic mud stamp of claim 1, wherein the tube-like member further comprises a decoupling mechanism configured to open the tube-like member.

4. A pneumatic mud stamp, consisting essentially of:

an applicator including;

a boot;

a faceplate with slots coupled to the boot; and a plurality of louvers internally disposed in the boot forming a channel therebetween, the louvers configured to apply the flow of mud in a pattern out of the applicator;

a tube-like member coupled to the applicator and including:

a first chamber configured to hold mud; and a second chamber configured to hold pressurized air, a stopper slidably disposed within the tube-like member between the first and second chambers, the stopper providing a fluid tight seal therebetween; and a pneumatic control configured to selectably dispose pressurized air into the second chamber.

5. The pneumatic mud stamp of claim 4, wherein the stopper comprises rubber.

6. The pneumatic mud stamp of claim 4, wherein the boot comprises a neoprene boot.

7. A pneumatic mud stamp, consisting of:

an applicator configured to apply mud in a pattern and including:

a boot;

a faceplate with a slot; and a plurality of louvers internally disposed in the boot, forming a channel therebetween;

a tube-like member coupled to the applicator and including:

a first chamber configured to hold mud;

a second chamber configured to hold pressurized air; and a decoupling mechanism configured to open the tube-like member for insertion of mud therein;

a stopper slidably disposed within the tube-like member between the first and second chambers, the stopper providing a fluid tight seal therebetween;

a refraction mechanism configured to facilitate moving the stopper away from the applicator, and a pneumatic control configured to selectably dispose pressurized air into the second chamber.

8. The pneumatic mud stamp of claim 1, wherein the faceplate is removably coupled to the boot.

9. The pneumatic mud stamp of claim 7, wherein in the faceplate is removably coupled to the boot.

10. The pneumatic mud stamp of claim 4, wherein the faceplate is removably coupled to the boot.

* * * * *

UNITED STATES PATENT AND TRADEMARK OFFICE

CERTIFICATE OF CORRECTION

PATENT NO. : 7,306,442 B2
APPLICATION NO. : 11/264579
DATED : December 11, 2007
INVENTOR(S) : Shirl G. Fox It is certified that error appears in the above-identified patent and that said Letters Patent is hereby corrected as shown below:

Title Page; item (76); should read;

Shirl G. Fox
221 Rex Layne Drive
Central, UT 84722

Signed and Sealed this

Eighth Day of July, 2008

JON W. DUDAS
*Director of the United States Patent and Trademark Office*